US008661621B2

(12) United States Patent
La See

(10) Patent No.: US 8,661,621 B2
(45) Date of Patent: Mar. 4, 2014

(54) CASEMENT WINDOW HINGE WITH REDUCED SASH-SAG

(71) Applicant: Jack C. La See, Abbotsford, WI (US)

(72) Inventor: Jack C. La See, Abbotsford, WI (US)

( * ) Notice: Subject to any disclaimer, the term of this patent is extended or adjusted under 35 U.S.C. 154(b) by 0 days.

(21) Appl. No.: 13/870,248

(22) Filed: Apr. 25, 2013

(65) Prior Publication Data

US 2013/0232727 A1 Sep. 12, 2013

Related U.S. Application Data

(60) Division of application No. 13/016,170, filed on Jan. 28, 2011, now Pat. No. 8,495,797, which is a continuation-in-part of application No. 12/166,448, filed on Jul. 2, 2008, now abandoned.

(51) Int. Cl.
*E05D 15/30* (2006.01)

(52) U.S. Cl.
USPC ..... 16/362; 16/368; 16/273

(58) Field of Classification Search
USPC ..... 16/362, 364, 366, 368, 369, 370, 371, 16/92, 93 R, DIG. 13, 385, 386, 273; 49/246, 247, 248, 250, 252, 396
See application file for complete search history.

(56) References Cited

U.S. PATENT DOCUMENTS 4,226,002 A * 10/1980 Davis ..... 16/273
4,726,092 A 2/1988 Tacheny et al.
4,790,106 A 12/1988 La See
4,882,805 A 11/1989 Campbell et al.
4,980,947 A 1/1991 McQuigge
5,040,267 A 8/1991 Dallmann
5,074,075 A 12/1991 La See
5,081,743 A 1/1992 Mayes
5,093,960 A 3/1992 Pemberton
5,152,102 A 10/1992 La See
RE34,657 E 7/1994 La See
5,392,494 A 2/1995 Wronski
5,450,654 A 9/1995 Sullivan
5,491,930 A 2/1996 La See
5,509,177 A 4/1996 Hinden et al.
5,586,362 A 12/1996 Baker
5,613,277 A 3/1997 Dallmann et al.
5,735,021 A 4/1998 Briggs
5,794,310 A 8/1998 Dallmann
5,964,011 A 10/1999 Ruston et al.
6,088,880 A 7/2000 La See
6,138,325 A 10/2000 Figliola et al.
6,302,382 B2 10/2001 Santelli, Jr.
6,308,650 B1 10/2001 Tsumiyama et al.
6,442,899 B1 9/2002 Gledhill
6,643,896 B2 11/2003 Carrier
6,928,697 B2 8/2005 Brain et al.

(Continued)

FOREIGN PATENT DOCUMENTS

GB 2240811 8/1991

*Primary Examiner* — Jeffrey O Brien
(74) *Attorney, Agent, or Firm* — Boyle Fredrickson S.C.

(57) ABSTRACT

A casement window hinge protects against sash sag by providing a guide arm that substantially fills the space between the sash and the window frame when the window is closed. This space-filling guide arm may be produced with lightweight thermoplastic material whose pivoting connection to the sash arm may be strengthened through a wood screw providing an axis for the pivot that may be stabilized within the sash into which the screw is driven.

4 Claims, 6 Drawing Sheets

(56) References Cited

U.S. PATENT DOCUMENTS

| | | | |
|---|---|---|---|
| 7,257,864 | B2 | 8/2007 | Liang et al. |
| 2002/0078528 | A1 | 6/2002 | Gledhill |
| 2005/0223524 | A1 | 10/2005 | Muir |
| 2007/0050947 | A1 | 3/2007 | Moore |
| 2007/0289100 | A1 | 12/2007 | Lake et al. |

* cited by examiner

CASEMENT WINDOW HINGE WITH REDUCED SASH-SAG

CROSS-REFERENCE TO RELATED APPLICATIONS

This application is a divisional application of U.S. application Ser. No. 13/016,170 filed Jan. 28, 2011, which is a continuation in part of U.S. application Ser. No. 12/166,448 filed Jul. 2, 2008, the disclosures of which are hereby incorporated by reference.

BACKGROUND OF THE INVENTION

The present invention relates to casement window hinges and in particular to a casement window hinge reducing sash sag.

Casement window hinges allow a window to open by pivoting about a vertical axis that moves inward as the window opens. This combination motion is provided by special casement window hinges supporting the window sash. A separate operator moves the window as mounted on the hinges, typically using a crank mechanism.

Casement window hinges typically employ a two-bar linkage of a sash arm and guide arm. The sash arm is attached along the window sash, for example, by countersunk wood screws directed up through the sash arm into the wood of the sash. An inward end of the sash arm is pivotally attached to a slide that may move along a track attached to the window opening and that defines the movable pivot point of the window. A center of the sash arm is pivotally attached to one end of a guide arm whose remaining end of the guide arm is pivotally attached to the track displaced from the slide.

The sash arm and guide arm can be subject to large forces, for example, during shipping, installation, or when the window is subject to wind loads. For this reason, the sash arm and guide arms are typically fabricated out of a sturdy material such as stainless steel. They are connected together, typically, by a metal rivet that is lightly staked to allow the parts to pivot. Normally the slide is also riveted to the sash arm.

A typical casement window has a total sash weight of 30 to 160 pounds and when closed may be supported by a one inch wide slide at the edge of the sash. This support point may be 10 to 20 inches from the center of gravity of the window. The offset between the support point and the center of gravity tends to tilt the top of the sash downward, the hinging side of the sash away from the support frame, and the bottom of the sash downward towards the support frame. Looseness in the hinge joints or the attachment screws in the hinge track from aging wood, or in the hinge arms, will allow more tilt. Size on size attachment screws and tight hinge joints minimizes the tilt but nevertheless ultimately still permit the sash to sag over time under weight of the glass. This sagging causes a deformation of the window from a true rectangle and can prevent closing the window to fit within the rectangular window opening without interference between the window and the opening and/or the casement window hinges.

Accordingly, it is known to attach the guide arm to the track or window opening with an eccentric pivot pin allowing the guide arm of the lower casement window hinge to be shortened to provide an upward lifting force on the sash as it is closed helping to lift it into position. Significant amounts of sash sag over time can impose substantial compression on the guide arm and its pivot point, requiring stronger materials to resist buckling and pivot pins requiring greater adjustment forces to prevent unwanted movement of the pivot pins under greater guide arm forces.

BRIEF SUMMARY OF THE INVENTION

The present invention provides a casement window hinge with a thickened guide arm that supports the sash against the track when the window is closed to reduce window sash sag. In one embodiment, this thickness is obtained by a thermoplastic guide arm that can provide the necessary dimensions, lubricity and shape to produce the necessary support when the window is closed. Practical and robust hinging of the thermoplastic guide arm and sash arm together is provided by a wood screw that can be stabilized in the sash itself.

Specifically, one embodiment of the present invention provides casement window hinge having a longitudinally extending track attachable along a window opening surface with a slide retainable by the track for movement therealong. A sash arm is pivotally attached to the slide at an inner end attachable to a window sash surface opposed to the window opening surface when the window is closed and a guide arm is pivotally attached at one end to the track and at the other end to the sash arm. At least a portion of an abutting guide arm and track substantially fills the space between the window opening surface and the window sash surface when the window is closed to support the window sash surface along the portion of the guide arm.

It is thus a feature of at least one embodiment of the invention to provide a system that reduces sash sag by supporting the sash when it is closed against the adjacent window opening.

The guide arm may include a thickened portion providing a surface of the guide arm adjacent to the window sash when the window is closed substantially aligned and parallel with a corresponding surface of the sash arm attached to the window sash.

It is thus a feature of at least one embodiment of the invention to employ the guide arm as a sash-supporting spacer when the window is closed.

The guide arm may be a thermoplastic material.

It is thus a feature of at least one embodiment of the invention to provide a lightweight, low friction material suitable for this space filling function. It is a further feature of the invention to provide a casement window design amenable to the use of a thermoplastic guide arm.

The guide arm may provide a sloped surface adjacent to the window sash when the window is closed and angled with respect to a plane of the window sash to guide the window sash surface up along the guide arm as the window closes.

It is thus a feature of at least one embodiment of the invention to provide a guide arm that can help realign the sash as the window is closed when there is minor sash sag.

The longitudinally extending track may have at least one countersunk hole for receiving wood screws for holding the longitudinally extending track to the window opening surface and the guide arm may provide at least one notch on a surface abutting the longitudinally extending track in the vicinity of at least one countersunk hole.

It is thus a feature of at least one embodiment of the invention to provide the space filling guide arm of the present invention without interference with mis-centered attachment screws protruding from the track.

The guide arm may be attached at an end of the sash arm.

It is thus a feature of at least one embodiment of the invention to prevent interference between the sash arm and thickened portions of the guide arm by employing a shortened sash arm The casement window hinge may further include a pivot between the guide arm and the track comprising a boss pivotally attached to the track and received in a snap fit with a corresponding bore in the guide arm.

It is thus a feature of at least one embodiment of the invention to permit rapid assembly of the casement window hinge by snapping engagement of these parts.

The boss may be eccentrically mounted for rotation with respect to the track.

It is thus a feature of at least one embodiment of the invention to provide for ancillary correction of sash sag by compressive force exerted upward on the sash by the guide arm.

The snap fit may be provided by an interfitting ridge and groove formed at a circumferential interface between the boss and corresponding bore.

It is thus a feature of at least one embodiment of the invention to provide an assembly technique suitable for use with thermoplastic components.

The distance between a surface of the guide arm adapted to contact the window sash surface and the surface of the longitudinally extending track contacting the window opening surface, before engagement of the snap fit between a partially assembled guide arm and boss, may be greater than the separation between the window opening surface and the window sash surface when the window is closed.

It is thus a feature of at least one embodiment of the invention to provide a positive indication that the boss and guide arm are not completely assembled when the window is first closed caused by interference between the guide arm and window. This feature prevents accidental sash fall out if the top guide arm is not completely assembled to the track boss which may happen with traditional steel casement hinges.

The exposed face of the boss includes a hexagonal bore for receiving a hex-wrench for rotation of the boss.

It is thus a feature of at least one embodiment of the invention to provide a compact but high torque method of rotating the eccentric pivot.

A second embodiment of the invention provides a casement window hinge having a longitudinally extending track attachable to a window opening and a slide retainable by the track for movement therealong. A sash arm is pivotally attached to the slide at an inner end attachable to a window sash and a guide arm is pivotally attached at one end to the track and at the other end to the sash arm. The sash arm and a guide arm are constructed of a moldable thermoplastic material and are joined by a wood screw passing through corresponding holes formed in the sash arm and guide arm to extend into the sash.

It is thus a feature of at least one embodiment of the invention to provide a casement window hinge that may employ thermoplastic linkage arms pivotally connected to each other and yet robust against high casement window forces. By employing a pivot pin that may screw into the sash, the pivot pin is stabilized by the sash, improving strength and stability.

The sash arm may include a collar portion surrounding the hole in the sash arm and extending into the hole in the guide arm to provide a bearing surface between the sash arm and guide arm separating the wood screw from the guide arm.

It is thus a feature of at least one embodiment of the invention to provide a desirable plastic-to-plastic interface in the pivot between the sash arm and guide arm when using a wood screw as a pivot.

The hole in the sash arm may be smaller than a crest diameter of threads of the wood screw.

It is thus a feature of at least one embodiment of the invention to reduce pivot play by threading the screw into the plastic of the sash arm.

The collar of the sash arm, when inserted in the guide arm, may extend into a counter bore for receiving a head of the wood screw in the guide arm and the end of the collar exposed in the counter bore may be staked over a bottom of the counter bore to retain the engagement between the sash arm and the guide arm without the wood screw.

It is thus a feature of at least one embodiment of the invention to provide retention of the sash arm and guide arm for installation before attachment using the screw.

The track may include a cantilevered cut-out deformed to extend into a path of travel of the slide, blocking travel of the slide unless the cantilevered portion is depressed.

It is thus a feature of at least one embodiment of the invention to provide a simple yet robust stop against over-opening of the casement window.

These particular features and advantages may apply to only some embodiments falling within the claims and thus do not define the scope of the invention.

Figure 2:
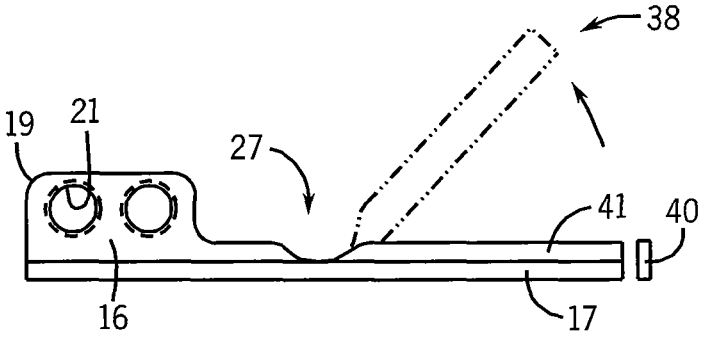
FIG. 2 is a top plan view of the slide of FIG. 1 showing an extension with a living hinge providing a stop for the window at full opening.
Figure 3:
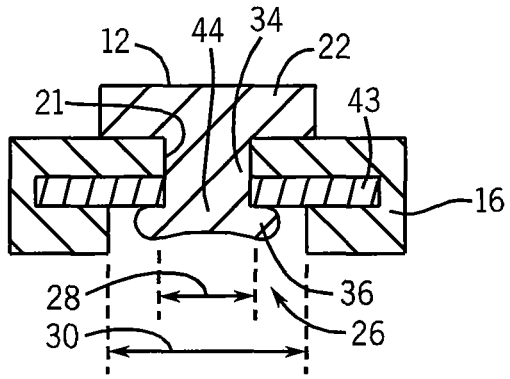
FIG. 3 is a cross-sectional view through lines 3-3 of FIG. 1 showing a thermally formed flange on a pivot pin attaching the sash arm to the slide, the flange received within a counter bore in a slide to remain recessed within the slide.
Figure 4:
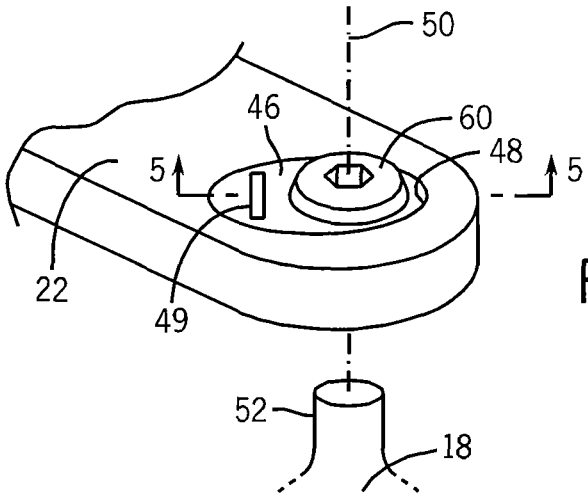
FIG. 4 is a fragmentary perspective view of a pivot mechanism connecting the guide arm to the track showing an eccentric mechanism for adjusting the effective guide arm length.
Figure 6A:
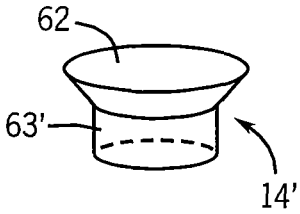
Figure 7:
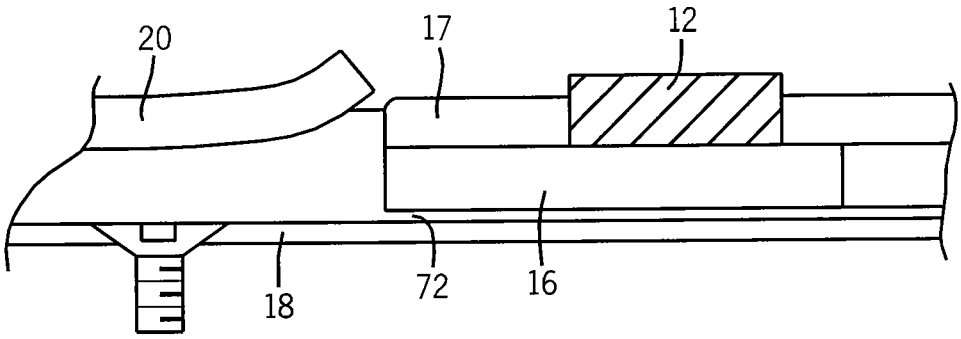
Figure 8:
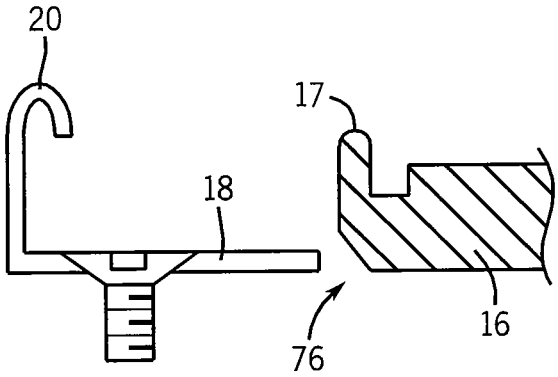
Figure 9:
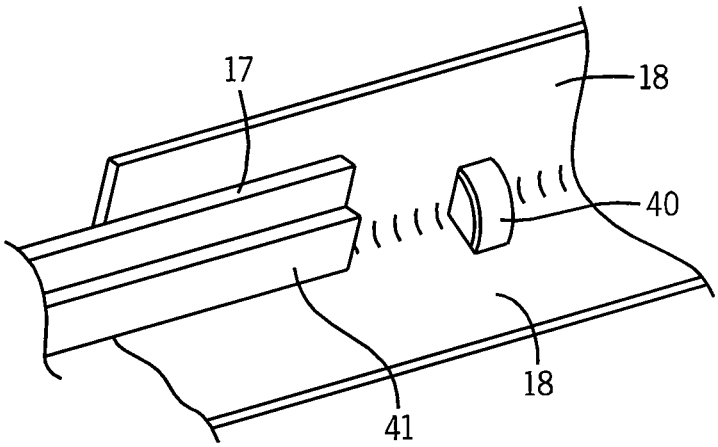
Figure 10:
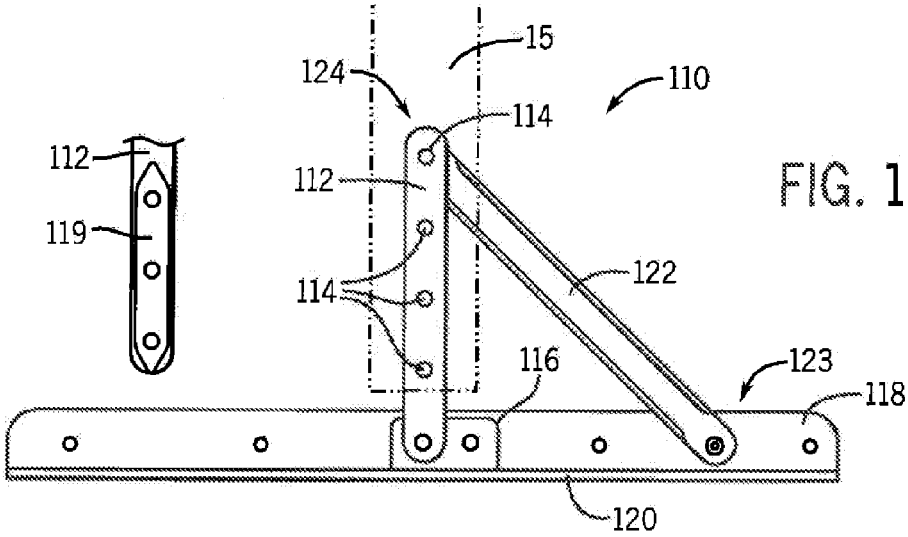
Figure 11:
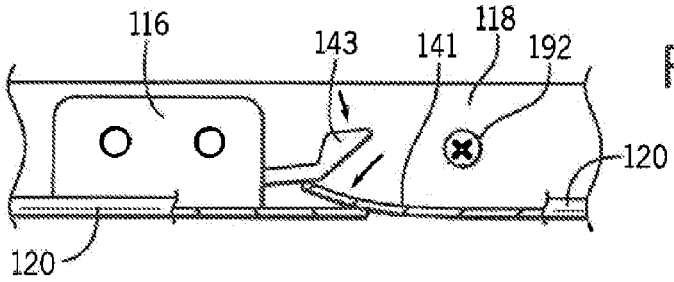
Figure 12:
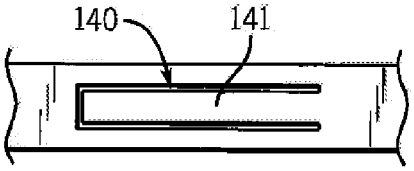
Figure 13:
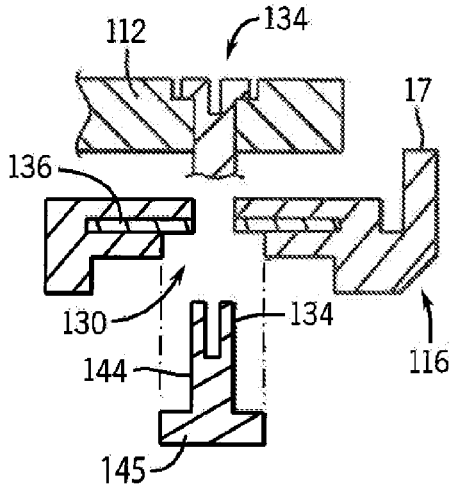
Figure 14:
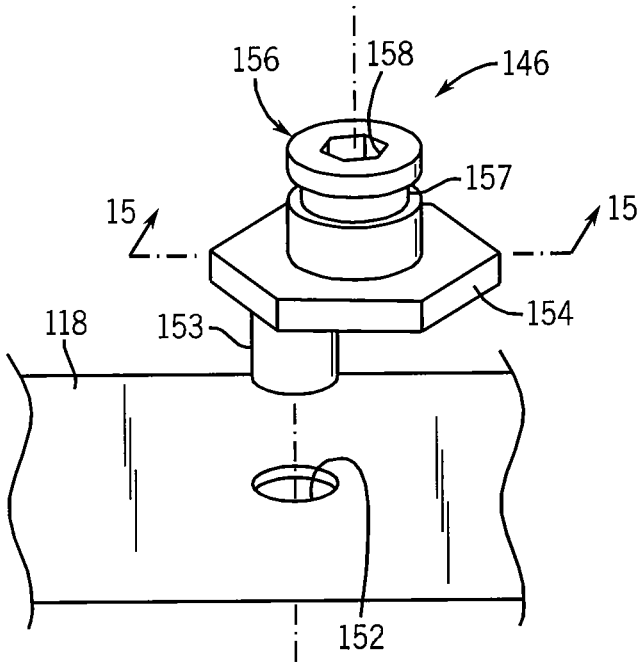
Figure 15:
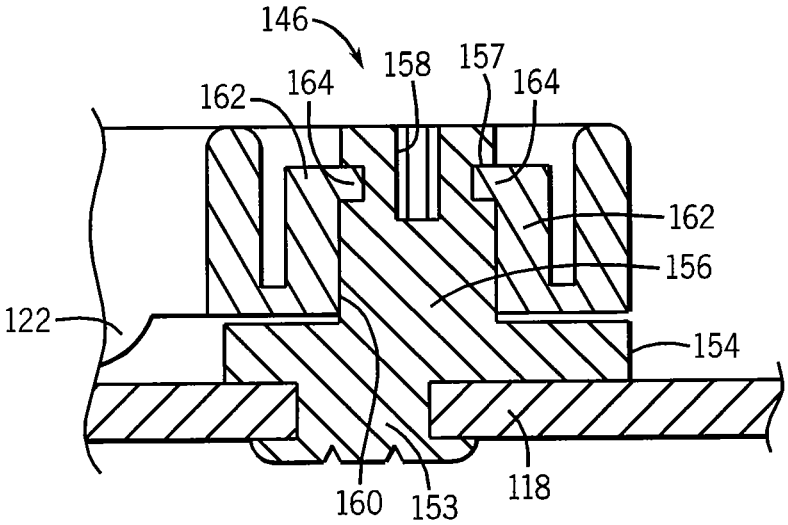
Figures 16, 17:
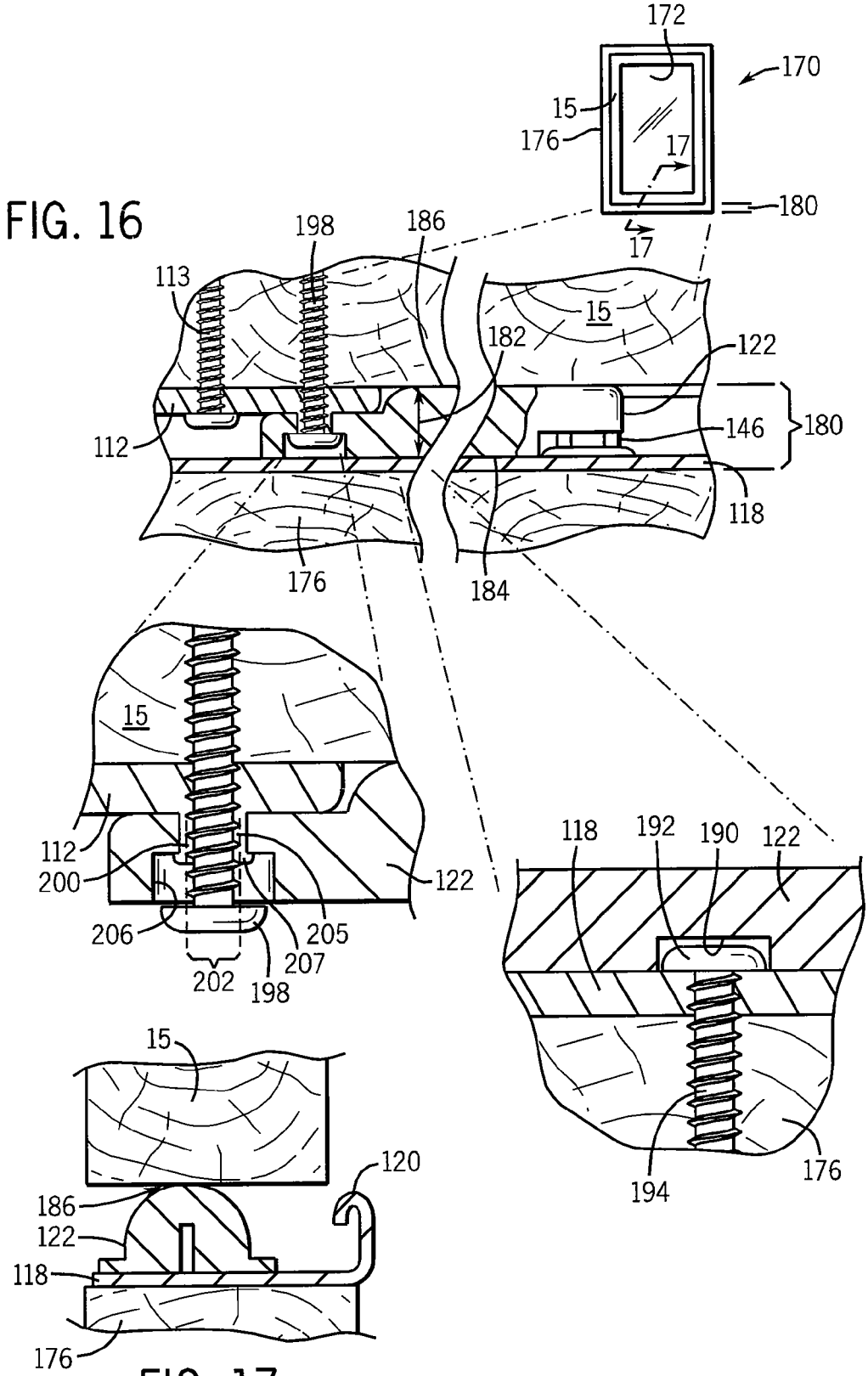

FIG. **6*a*** is a phantom view of a prior art countersunk bore in the sash arm;

FIG. **6*b* is a figure similar to that of FIG. 6*a*** showing a bore with extended surface area providing increased pullout resistance to wood screws;

FIG. 7 is a front elevational view in partial cross-section of the track and slide of the present invention showing a flared track channel permitting alignment of the slide with the track for windows for ease of assembly;

FIG. 8 is a figure similar to FIG. 7 in side elevation, showing a chamfer on the slide permitting alignment of the slide and the track;

FIG. 9 is a fragmentary perspective view of the extension of FIG. 2 and corresponding stop formed in the slide;

FIG. 10 is a top plan view of the casement window hinge, of a second embodiment of the present invention, showing the sash arm, guide arm, slide and track structures;

FIG. 11 is a fragmentary detail view in partial cutaway of the track of FIG. 10 showing an alternative stop mechanism to that shown in FIGS. 2 and 9 employing a cutout of the track wall;

FIG. 12 is a fragmentary front elevational view of the cutout of FIG. 11;

FIG. 13 is an exploded fragmentary perspective view of an attachment between the sash arm and the slide providing an alternative to that shown in FIG. 3;

FIG. 14 is an exploded perspective fragmentary view of an eccentric boss joining the guide arm and track in an alternative to the mechanism shown in FIG. 4;

FIG. 15 is a cross-section through lines 15-15 of FIG. 14 showing assembly of the boss to the track for this alternative mechanism;

FIG. 16 is a series of expanding, fragmentary cross-sections showing support of the sash by the guide arm when the window is closed and attachment of the guide arm to the sash arm with a sash engaging screw; and FIG. 17 is a fragmentary cross-section along lines 17-17 of FIG. 16 showing support of the sash on the guide arm when the window is closed.

DETAILED DESCRIPTION OF THE INVENTION

First Embodiment

Figure 1:
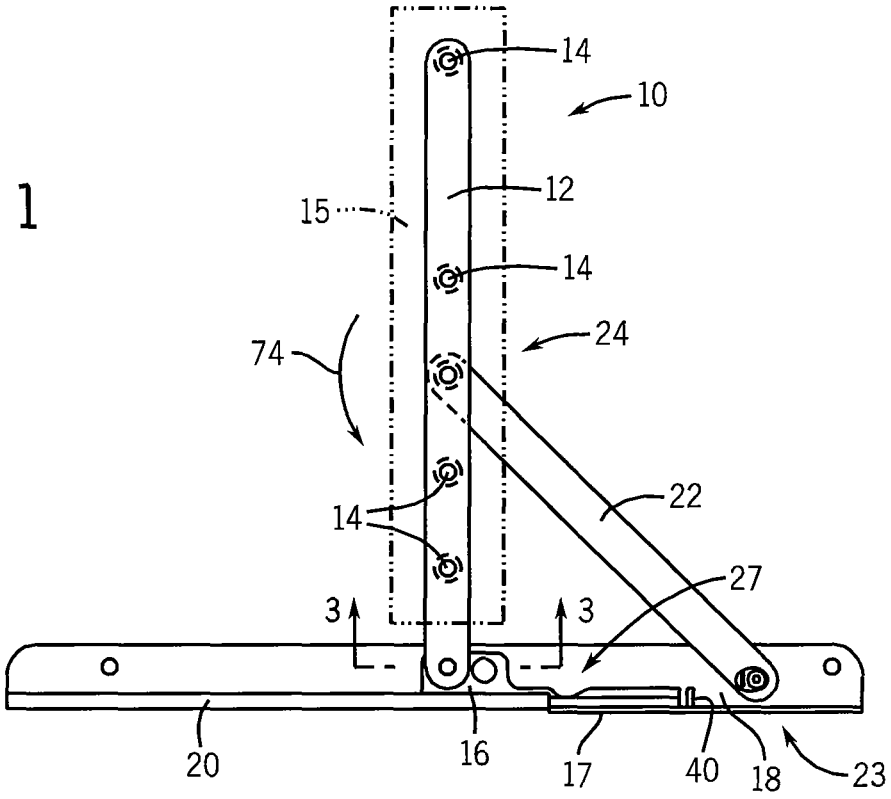
FIG. 1 is a top plan view of the casement window hinge, of a first embodiment of the present invention, showing the sash arm, guide arm, slide and track structures common to hinges of this type.

Referring now to FIG. 1, in a first embodiment, a casement window hinge 10 may include a sash arm 12 that may be attached to a window sash 15 by means of mounting holes 14 receiving countersunk head wood screws (not shown in FIG. 1) upward through the sash arm 12 therethrough. A proximal end of the sash arm 12 is pivotally attached to a slide 16 that may move along a length of a metal track 18 as retained by a rolled flange 20 in the metal track 18.

A proximal end of a guide arm 22 is pivotally attached to the track 18 at an end 23 of the track 18 removed from the travel range of the slide 16, and a distal end of the guide arm 22 is pivotally attached to a midpoint 24 of the sash arm 12. The sash arm 12 and guide arm 22 form a two-bar linkage providing a simultaneous pivoting and translation of an attached window sash. The general structure of hinges of this type is described in U.S. Pat. No. 6,088,880 to LaSee, assigned to the assignee of the present invention and hereby incorporated by reference.

Referring now also to FIG. 2, the slide 16 includes a leftward extending stop arm 41 whose end may abut a stop 40 formed in the track 18 to prevent the window from opening too far as will be described below.

A rear edge of the slide 16 and stop arm 41 supports an upwardly extending ridge 17 that may be captured under the rolled flange 20 of the track 18. This ridge 17 extends leftward from a slide body 19 to provide a living hinge 27 between the slide body 19 and the stop arm 41 allowing the latter to flex to an assembly position 38 away from the stop 40 so that the slide 16 may be assembled into the track 18 at a portion of the track 18 not having the rolled flange 20. Upon completion of that assembly, the natural elasticity of the living hinge 27 returns the stop arm 41 to the straightened position so that leftward travel of the slide 16 is ultimately blocked by the stop 40.

Referring now to FIG. 3, the slide 16 and distal end of the sash arm 12 include counter bored holes 21 having a principal diameter 28 and a counter bore 26 with a diameter 30 on their underside diameter 30 being larger than principal diameter 28. Corresponding pivot pins 44 on the sash arm 12 may extend downward from the surface of the sash arm 12 to be received within these counter bores 26. The pivot pins 44 have a cylindrical shaft 34 with a diameter conforming to principal diameter 28 of the hole 21.

An end of the shafts 34 extending through the principal diameter 28 of the bores 26 may be thermally staked to create a flanged head 36 of diameter less than the counter bore diameter 30 and a thickness less than the depth of the counter bore 26 to fit wholly therein, but of diameter greater than the principal diameter 28 of the counter bored holes 21 so as to retain the pivot pin 44 within the counter bored holes 21. The staking process may be performed by a number of thermal staking techniques including ultrasonic or heated plate staking and provides a near zero-tolerance fit between a flanged head 36 and a seat of the counter bored holes 21 with very little compressive force as a result of the melting of the material of the pivot pin 44.

In a second embodiment, the flanged head 36 may be preformed to a diameter allowing a snap fit with the counter bored holes 21. The flanged head 36 may be bored and slotted to assist in its compression during this snap fit.

Ideally, the pivot pins 44 are molded to be integral with the thermoplastic sash arm 12, a material choice for the sash arm 12 that is made possible by fabricating the sash arm 12 of a thermoplastic material strengthened, for example, with glass fiber. By constructing both the sash arm 12 and guide arm 22 out of thermoplastic, a plastic-to-plastic interface is formed resisting binding and destructive wear between the pivot pin 44 and the sash arm 12 or guide arm 22.

As will be understood in the art, the slide 16 may also be molded from a thermoplastic material and typically is molded about a steel spine 43 which, in this case, may include a hole amply sized to allow the molding of the counter bored hole 21 into the slide 16.

Figure 5:
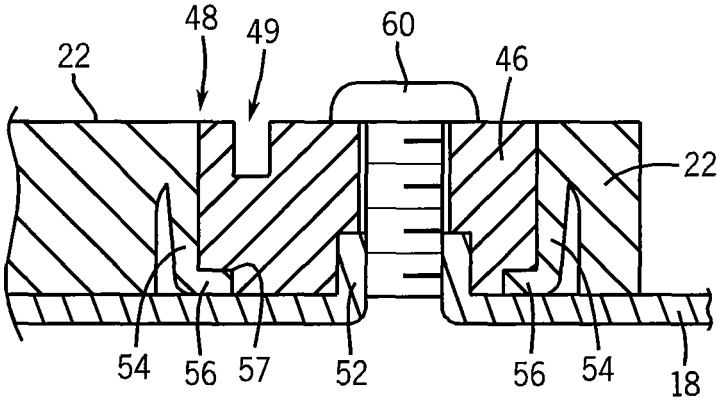
FIG. 5 is a cross-section through lines 5-5 of FIG. 4 showing assembly of the eccentric mechanism to a coined post on the track.

Referring now to FIGS. 1, 4 and 5, the attachment of the proximal end of the guide arm 22 to the track 18 (constructed of sheet metal in the present invention) is obtained through a molded thermoplastic boss 46 attached to the track 18 (as will be described) and snap-fitted into a corresponding bore 48 in the proximal end of the guide arm 22. The boss 46 has a generally cylindrical outer surface and thus may rotate within the guide arm 22 when twisted by a screwdriver inserted into a slot 49 cut in the upper face of the boss 46. The boss 46 provides a rotation axis 50 with respect to its attachment to the track 18 (as will be described) that is eccentric with respect to an outer circumference of the boss 46. Thus, rotation of the boss 46 with respect to the guide arm 22 causes an effective change of the length of the guide arm 22 as may correct for sash sag as described generally in U.S. Pat. Nos. 4,790,106 and 5, 017,075, assigned to the same assignee as the present invention and hereby incorporated by reference.

Referring to FIG. 5, the attachment of the boss 46 to the track 18 is provided by means of a coined protrusion in the track 18 providing an upwardly extending, upwardly open tube 52 integrally formed in the track 18. The inside of this open tube 52 may be threaded to receive a pan head, hex drive, machine screw 60 whose head may retain the boss 46 against axial movement with respect to the track 18 while allowing rotational movement of the boss 46 about the machine screw 60

The snap connection between the boss 46 and the guide arm 22 is provided by opposed downwardly cantilevered spring fingers 54 molded into the inner diameter of the bore 48 of the guide arm 22 receiving the boss 46. Teeth 56 at the lower edge of the spring fingers face inward to receive a corresponding outwardly open rim 57 in the lower edge of the boss 46.

Figure 6B:
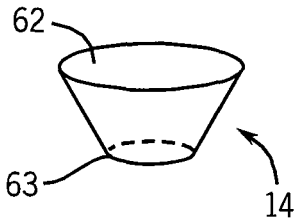

Referring now to FIGS. 6*a* and 6*b*, in a prior art, hole 14' receiving countersunk head wood screws to attach the sash arm 12 to a window sash provided an amply-sized countersink bore 63' cut through the sash arm 12 avoiding interference between a shaft of the wood screw and a too-small bore in a metallic sash arm 12. Limited conical countersinking 62' is provided so that the head of the wood screw would be flush with a surface of the sash arm 12 to prevent interference in the opening and closing of the window by a protruding screw head.

In the present invention, the radius of the countersink bore 63 is significantly reduced to equal or be slightly less than the expected diameter of the shaft of a wood screw. This reduction in radius increases the total area of the conical countersinking 62 as a square of the reduction in radius to provide sufficient pullout resistance in the plastic of the sash arm 12. The conical countersinking 62 provides a frustro-conical surface having an upper base of greater diameter and a lower base of lesser diameter. In the preferred embodiment, the radius of the upper base is no less than substantially twice the radius of the smaller base. The increased risk of interference between the smaller hole size of the smaller base and the shaft of the wood screw is remedied by the soft characteristic of the plastic material allowing the wood screw to slightly enlarge this hole as needed. The present inventor has determined that this radius reduction provides a sufficient pullout resistance to allow construction of the sash arm 12 from a reinforced plastic material.

Referring now to FIG. 7, the slide 16 may be pulled upward by an amount 72 when sash arm 12 is attached to a sash (not shown) in a window sash that is dimensionally shorter than expected. This can make it difficult to insert a guide ridge 17 of the slide 16 under the rolled flange 20. For this reason, the present invention provides for an upward flaring of the rolled flange 20 to provide a funneling of the guide ridge 17 of the slide 16 into the rolled flange 20 when the slide 16 is first assembled onto that track 18. Similarly, as shown in FIG. 8, a rear edge of the slide 16 includes a chamfer 76 so that, in the opposite situation, where the slide 16 is displaced downward when used with a window sash that is dimensionally taller than expected, the chamfer 76 guides the slide 16 up onto the surface of the track 18.

Referring now to FIGS. 1 and 9, opening of the sash 15 such as would move the sash 15 leftward 74 beyond a perpendicular orientation with respect to the track 18 is stopped by abutment of the stop arm 41 of the slide 16 against the stop 40. This portion of the track 18 near the stop 40 does not have a rolled flange 20 allowing the stop arm 41 to be flexed by means of a living hinge 27 away from the stop 40 for disassembly.

Second Embodiment

Referring now to FIG. 10, in a second embodiment, a casement window hinge 110 may include a sash arm 112 attached to a window sash 15 by means of mounting holes 114 in the sash arm 112 receiving four pan head wood screws (not shown in FIG. 10) upward through the sash arm 112 into the sash 15. A proximal end of the sash arm 112 is pivotally attached to a slide 116 that may move along a length of a metal track 118 as retained by a rolled flange 120 in the metal track 118.

An optional metal reinforcement strip 119 may be placed between the proximal end of the sash arm 112 and the slide 116 to add more stiffness to the sash arm on very wide casement sashes.

A proximal end of a guide arm 122 is pivotally attached to the track 118 at an end 123 of the track 118 removed from the travel range of the slide 116, and a distal end of the guide arm 122 is pivotally attached at the end 124 of the sash arm 112. As before, sash arm 112 and guide arm 122 form a two-bar linkage providing a simultaneous pivoting and translation of an attached window sash.

Referring now also to FIGS. 11 and 12, the track 118 may include a cut out 140, for example, produced by a die cutting operation and formed in its vertical rear wall. The cut out 140 provides a cantilevered finger 141 separated from the track 118 on three of four sides so that it may be bent outward to extend flexibly into the path of the slide 116. The cantilevered end of the finger 141, extending from the track 118, prevents the slide 116 from passing the finger 141 when the slide 116 approaches the finger 141 from the left, as shown, during opening of the window and thus prevents opening of the window too widely. The slide 116 may be maneuvered past the finger 141 in this direction, for disassembling of the window, by using a slide release lever 143 attached to the slide 116 by a living hinge, being molded with the slide 116 from thermoplastic, the slide release lever pressing the finger 141 into alignment with the rest of the track 118 against the natural spring resilience of the material of the finger 141. During assembly of the window, the orientation of the finger 141 is such that motion of the slide leftward naturally presses the finger 141 into the track 118 allowing free passage of the slide 116.

As shown in FIG. 7 above, the rear edge of the slide 116, like slide 16, supports an upwardly extending ridge 17 that may be captured under the rolled flange 120 of the track 118.

Referring now to FIG. 13, the slide 116 may include and in-molded steel plate 136 positioned in a horizontal portion of the slide 116. A bottom of the steel plate 136 is exposed at the base of an upwardly extending counter bore 130 to receive the head 145 of a brass rivet 144 so that the head rests directly against the steel plate 136. A shaft of the rivet 144 may extend through a hole centered in the counter bore 130 and pass through the steel plate 136 and the slide 116 to engage a corresponding hole in the strip 119 and the sash arm 112 and extend therethrough. A shank of the rivet 134 may then be staked over the sash arm providing a pivoting connection between the sash arm 112 and the slide 116. Sliding motion of the rivet 144 is largely limited to the interface between the rivet 144 and the slide 116 to limit wear that might otherwise occur between the rivet 134 and the sash arm 112.

Referring now to FIGS. 10, 14 and 15, the attachment of the proximal end of the guide arm 122 to the track 118 may be obtained through an eccentric pivot 146, for example, machined brass. The eccentric pivot 146 may be attached to a hole 152 in the track 118 receiving a cylindrical stud 153 extending downward from the eccentric pivot 146. The end of this stud 153 passing through the track 118 may be staked over to capture the material of the track 118 as shown in FIG. 15 permitting rotation of the eccentric pivot 146 about the axis of the stud 153. This rotation may be facilitated by hexagonal flats 154 in the body of the eccentric pivot 146 to be turned by an open end wrench or the like.

The eccentric pivot 146 further includes an upwardly extending cylindrical pivot pin 156 having a circumferential groove 157. An axis of this cylindrical pivot pin 156 is offset from the axis of the stud 153 to provide a point of pivot that may be adjusted eccentrically about the hole 152 by rotation of the eccentric pivot 146. A hex socket 158 may be cut into the upper surface of the cylindrical pivot pin 156 to augment the flats 154 for rotation of the eccentric pivot 146.

Referring to FIG. 15, a bore 160 in the end of the guide arm 122 may receive the outer surface of the cylindrical pivot pin 156. The bore 160 may include flexing fingers 162 having radially inwardly extending teeth 164 that may engage the cylindrical groove 157 to provide a snap fitting between the guide arm 122 and the eccentric pivot 146. Prior to full engagement between the guide arm 122 and the eccentric pivot 146, when the bore 160 only partially receives a cylindrical pivot pin 156, the height of the guide arm 122 above the track 118 will be such as to cause interference in the closing of the window as will be described.

As previously described, rotation of the eccentric pivot 146 with respect to the guide arm 122 causes an effective change of the length of the guide arm 122 as may correct for minor sash sag.

Referring now to FIG. 16, a window 170 of the type suitable for use with the present invention may include one or more glass panes 172 surrounded by a rectangular sash 15 typically of wood or the like. The sash 15 may fit into a window frame 176 defining a window opening by its internal periphery. Generally, when the window 170 is closed, there will be a separation distance 180 between the outer surface of the sash 15 and the window frame 176, above and below the sash 15, in which the casement window hinges may rest.

The guide arm 122 in this embodiment of the invention may have a vertical thickness 182 such that when an outer surface 184 (lower surface in FIG. 16) of the guide arm 122 abuts the inner (upper) surface of the track 118, when the latter is supported by the window frame 176, the inner surface 186 of the guide arm 122 abuts the lower surface of the sash 15 supporting the sash 15 over the length of the guide arm 122. Typically, this extent of support will be on the order of 7 inches, or greater than 4 inches, or greater than 70% of the length of the guide arm 122. As noted, the guide arm 122 may be constructed of a thermoplastic material providing low friction between its sliding contact with the track 118 and the sash 15.

The vertical thickness of the guide arm 122, which together with the thickness of the track 118, essentially fills the distance 180, ensures that any incomplete attachment of the guide arm 122 to the eccentric pivot 146 may be instantly detected as the window is closed as the extra height of the guide arm 122 above the track 118 will cause interference with such closure, something that may not occur with standard guide arms permitting such misassembly to go undetected.

Referring momentarily to FIG. 17, the inner surface 186 of the guide arm 122 may be beveled or canted in cross section with respect to the plane of the lower surface of the sash 15 to provide a guiding wedge surface lifting the sash 15 upward should sash sag cause the separation between the sash 15 and the frame 176 to drop below distance 180.

Referring again to FIG. 16, the lower surface 184 of the guide arm 122 may include periodic notches 190 providing clearance with protruding heads 192 of wood screws 194 attaching the track 118 to the frame 176. These notches 190 permit the close sliding interaction between the guide arm 122 and the track 118 allowing for support of the sash 15.

Referring still to FIG. 16, the pivoting attachment between the guide arm 122 and the sash arm 112 may be made by means of a wood screw 198 passing through both the guide arm 122 and the sash arm 112 and into the sash 15. Stabilization of screw 198 in the sash 15 protects the thermoplastic sash arm 112 from forces imposed on it by the guide arm 122 such as are conducted into the sash 15 by the wood screw 198. The stabilization of the screw 198 further resists torsional deflection of the sash arm 112 and the guide arm 122 to which it is attached.

The sash arm 112 may include an outwardly extending collar 200 surrounding the shaft of the wood screw 198 as it passes both through the sash arm 112 and through the guide arm 122. A bore through this collar 200 may be smaller than a crested diameter 202 of the threads of the screw 198 so that the threads cut into the thermoplastic material of the bore of the collar 200 may reduce any play between the sash arm 112 and screw 198. The collar 200 further provides an outer bearing surface 204 between the sash arm 112 and the guide arm 122 receiving the collar to provide reduced wear between these two components. The collar 200 may pass through a bore 205 in the guide arm 122 and into a counter bore 206 in the guide arm 122 intended to receive the head of the screw 198. There a protruding lip 207 of the collar 200 may be swaged radially outward to grip the bottom of the counter bore 206 thereby retaining the sash arm 112 in connection with the guide arm 122 prior to installation, simplifying assembly. Screw 198 is then tightened down onto the exposed lip 207 to be fully received within the counter bore 206. The collar 200 and lip 207 prevent rotation forces of the guide arm 122 from unscrewing screw 198.

Referring still to FIG. 16, the pan head wood screws 113 used to attach the sash arm 112 to the sash 15 (other than screw 198), may also fit into slightly undersized holes through the sash arm 112 to prevent shifting of the sash arm 112 along the sash 15. The heads of the screws 113 may fit tightly against the surface of the sash arm 112 to also help prevent slippage. In the prior art, such slippage can permit sash sag on both the top and bottom hinges caused by forces generated by the offset center of gravity of the window sash.

Certain terminology is used herein for purposes of reference only, and thus is not intended to be limiting. For example, terms such as "upper", "lower", "above", and "below" typically refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence, or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A casement window hinge comprising:

a longitudinally extending track attachable to a window opening;

a slide retainable by the track for movement therealong;

a sash arm pivotally attached to the slide at an inner end and attachable to a window sash;

a guide arm pivotally attached at one end to the track and at the other end to the sash arm;

the sash arm and the guide arm are constructed of a moldable thermoplastic material and are joined by a screw passing through a sash arm hole and a guide arm hole to extend into the sash, the sash arm hole and the guide arm hole are coaxial;

the sash arm includes an integral collar extending coaxially with the sash arm hole toward the guide arm and extending into the guide arm hole to provide a bearing surface between the sash arm and guide arm separating the screw from the guide arm;

the collar of the sash arm when inserted in the guide arm hole extends into a counter bore for receiving a head of the screw in the guide arm and wherein an end of the collar exposed in the counter bore is staked over a bottom of the counter bore to retain an engagement between the sash arm and the guide arm and to prevent the screw from contacting the guide arm.

2. The casement window hinge of claim 1 wherein the sash arm hole is smaller than a crest diameter of threads of the screw.

3. The casement window hinge of claim 1 wherein the track includes a cantilevered cut out deformed to extend into a path of travel of the slide blocking travel of the slide unless the cantilevered portion is depressed.

4. The casement window hinge of claim 3 wherein the slide includes a cantilevered finger that may be pressed to push the cantilevered cut out into alignment with the track allowing the slide to move past the cantilevered cut out.

* * * * *